US005533919A

United States Patent [19]

Peterson

[11] Patent Number: 5,533,919

[45] Date of Patent: Jul. 9, 1996

[54] TOPPLING TOY

[76] Inventor: Laverne R. Peterson, P.O. Box 401, Breesport, N.Y. 14816

[21] Appl. No.: 543,753

[22] Filed: Oct. 16, 1995

[51] Int. Cl.[6] ..... A63H 33/00

[52] U.S. Cl. ..... 446/2; 273/391

[58] Field of Search ..... 446/2, 331, 487, 446/486; 273/86 D, 86 R, 391, 392

[56] References Cited

U.S. PATENT DOCUMENTS

| | | | |
|---|---|---|---|
| 2,289,690 | 7/1942 | Bakalyar | 446/2 |
| 2,455,430 | 12/1948 | Luckhaupt | 446/331 |
| 2,535,973 | 12/1950 | Voges | 273/391 |
| 2,587,042 | 2/1952 | Haiselup | 446/2 |
| 4,428,147 | 1/1984 | Yoshida | 446/2 |
| 4,998,902 | 3/1991 | Garner et al. | 446/2 |
| 5,083,960 | 1/1992 | Erickson | 446/2 |
| 5,110,138 | 5/1992 | Vandermeide | 273/391 |
| 5,207,793 | 5/1993 | Brand et al. | 273/445 |
| 5,349,129 | 9/1994 | Wisniewski et al. | 446/2 X |

*Primary Examiner*—Mickey Yu
*Attorney, Agent, or Firm*—Richard C. Litman

[57] ABSTRACT

A toppling toy having a housing on which a plurality of toppling members are sequentially arranged, having a reset mechanism which resets the toppling members simultaneously. The housing has a top wall, a bottom wall, and a continuous side wall, defining a cavity between the walls. Each toppling unit is a toppling member and a ballast member fixedly attached to and suspended from the toppling member by a flexible member attached to the toppling member. The reset mechanism is characterized by a disc-shaped push-button protruding through an opening in the top wall. The push-button is permanently affixed to a flange housed within the cavity. The flange is supported and biased by a resilient member, such as a foam annulus, resting on the bottom wall. The flange also defines pairs of holes which are brought into registry with pairs of apertures defined by the top wall, through which holes and apertures the resilient member has been passed so that, during the ready state of the toy, the ballast member hangs freely in the cavity. After toppling the toppling members, the toppling members are reset by depressing the push-button causing the flange to move vertically downward and compress the resilient member. As the flange moves downward, it forces the ballast member downward causing the flexible member to become taut, which tilts the toppling member into an upright position, whereupon the push-button may be released.

6 Claims, 4 Drawing Sheets

TOPPLING TOY

BACKGROUND OF THE INVENTION

1. Field of the Invention

The present invention relates to a toy for amusement by toppling over a plurality of sequentially arranged toppling members, having a reset mechanism which can reset all the toppling members simultaneously.

2. Description of the Prior Art

Toppling toys using easily reset upright toppling members are known in the prior art. Dominoes have been the traditional amusement of this type. When dominoes are set on end so as to achieve a line of desired interest and length and positioned in the appropriately spaced relationship, the first domino may be tipped over to cause each the remaining domino tiles to topple in sequence, giving rise to the term "domino effect". However, resetting the dominoes for another topple then presents a time consuming chore.

To address this problem, a variety of inventions found in the prior art utilize tiles hinged to a housing or track of some type; but, none utilize the mechanisms as disclosed by the present invention, nor are any capable of resetting all toppling members of the toy essentially simultaneously. For example, U.S. Pat. No. 2,289,690 issued Jul. 14, 1942 to Bakalyar describes a toppling toy having an elongated base and a series of spaced upright blocks having their lower ends pivoted to the base by a flexible member. A slide bar having lugs returns fallen blocks progressively to their upright positions as the slide bar is slid longitudinally within a channel in the base. Similarly, U.S. Pat. No. 2,587,042 issued Feb. 26, 1952 to Haiselup describes a toy with L-shaped upright members and a base portion forming a channel having sides. The upright members are pivotally connected between the sides of the channel so that a continuous flexible cord, passing through each upright member successively, may be tautened to erect the fallen members.

U.S. Pat. No. 4,998,902 issued Mar. 12, 1991 to Garner et al. describes an improved toppling toy characterized by slotted tracks having a resetting capability that utilizes a plurality of finger tip operated actuators operated by a "finger dragging lane" dedicated to pivoting the tiles upright.

Other devices using toppling tiles are known, but none disclose mechanisms to assist resetting the tiles. U.S. Pat. No. 4,428,147 issued Jan. 31, 1984 to Yoshida describes a domino, toppling toy utilizing actuation and toppling levers to start a toppling sequence; however, dominoes are set manually. U.S. Pat. No. 5,083,960 issued Jan. 28, 1992 to Erickson describes a toy in which the toppling element is hinged to a section of track which is linkable with other sections of track; however, no mechanism for returning the toppling element upright is disclosed. U.S. Pat. No. 5,349,129 issued Sep. 20, 1994 to Wisniewski et al. describes an electronic sound generating toy when domino sound elements topple from an indented track, triggering a decoding circuit for determination of a sound pattern.

Finally a spring-biased mechanism for resetting pegs in a hammering game, during which game players attempt to drive grooved pegs through apertures in a revolving circular platform, is described in U.S. Pat. No. 5,207,793 issued May 4, 1993 to Brand et al. In order to reset the game, the platform is spring-supported and is pressed down to cause the pegs to engage a rib and be forced upward. This mechanism is inappropriate for raising flexibly hinged toppling members.

None of the above inventions and patents, taken either singly or in combination, is seen to describe the instant invention as claimed.

SUMMARY OF THE INVENTION

The present invention relates to a toy for amusement by toppling over a plurality of sequentially arranged toppling members, having a reset mechanism which sets up all the toppling members simultaneously. The toppling toy includes a housing, a plurality of toppling units, and a reset mechanism.

In the preferred embodiment, the housing is cylindrical, having an top wall, a bottom wall acting as a base, and a continuous side wall, defining a cavity between each of the surfaces. Each toppling unit is made up of a toppling member and a ballast member, fixedly attached to and suspended from the toppling member by a flexible member. The reset mechanism is characterized by a disc-shaped push-button, protruding through a centrally located opening in the top wall. The push-button or protruding member is permanently affixed to an outer circular flange residing within the cavity. The flange is supported and biased by a resilient member, such as a foam annulus as shown in the preferred embodiment, positioned within the cavity and resting on the bottom wall. The flange also defines pairs of holes which are brought into registry with pairs of apertures defined by the top wall, through which holes and apertures the resilient member has been passed so that, during the ready state of the toy, the ballast member hangs freely within the cavity.

After toppling the toppling members, the toppling members are reset by depressing the push-button causing the flange to move vertically downward and compress the resilient member. As the flange moves downward, it reaches a point where it comes into contact with the ballast member. The ballast member is thus forced downward causing the flexible member to become taut, which begins to retract the toppling member towards the apertures. At a given point the toppling member, being attached to the flexible member, tilts into an upright position, whereupon the push-button may be released.

Accordingly, it is a principal object of the invention to provide a toppling toy for amusement.

It is another object of the invention to provide a toppling toy having means for resetting the toppling members.

It is a further object of the invention to provide a toppling toy having a resetting means capable of erecting the toppled members simultaneously.

Still another object of the invention is to provide a toppling toy adapted for modular use whereby multiple toys interactively trigger toppling members to topple.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to an apparatus for amusement by toppling over a plurality of sequentially arranged toppling members, having a reset mechanism which can reset all the toppling members simultaneously.

Figure 1:
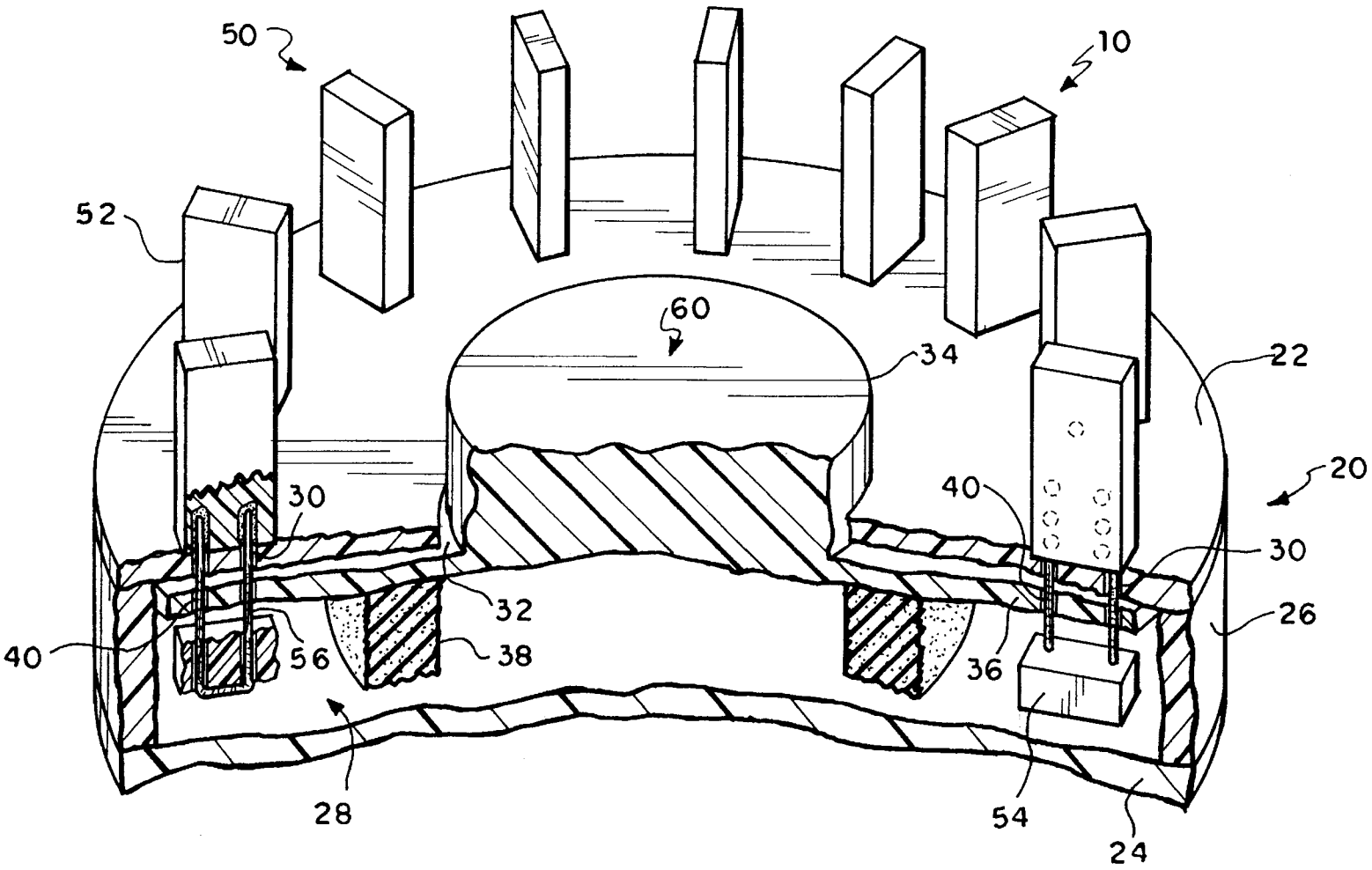
FIG. 1 is an perspective view in section of the preferred embodiment of the toppling toy.
Figure 3B:
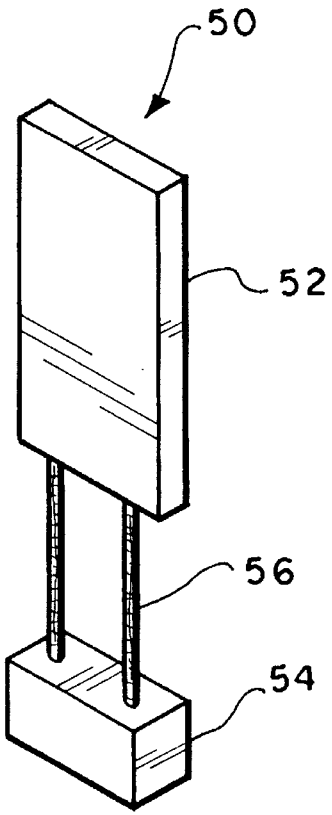
FIG. 3B is a, perspective view of a detail of an embodiment of the toppling toy.

FIG. 1 represents the preferred embodiment of a toppling toy 10 in a state made ready for use. The toppling toy 10 includes a housing 20, a plurality of toppling units 50, and a reset mechanism 60. The housing 20 is shown in the preferred embodiment to be cylindrical, having an top wall 22, a bottom wall 24 acting as a base, and a continuous side wall 26 defining a cavity 28 between each of the surfaces 22, 24. As can be best appreciated from FIG. 3B, each toppling unit 50 is made up of a toppling member 52 and a ballast member 54, the ballast member 54 being fixedly attached to and suspended from the toppling member 52 by a flexible member 56. Referring again to FIG. 1, the ballast member 54 is shown in its ready state, freely suspended in the cavity 28 of the housing 20 and in communication with the toppling member 52 by means of the flexible member 56.

Figure 4:
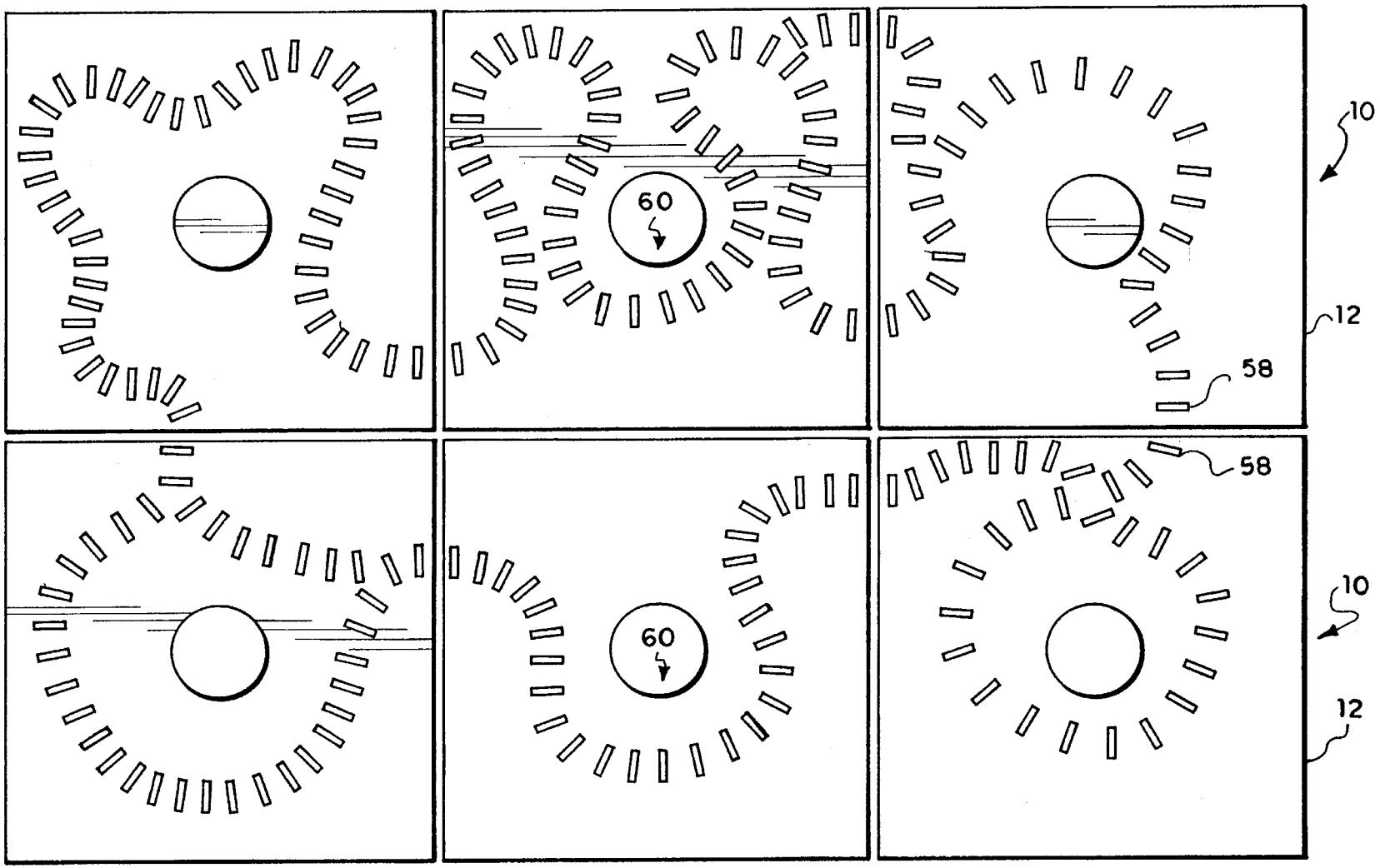
FIG. 4 is a plan view of a layout of plural adjacent toys of multiple embodiments.

The top wall 22 defines a plurality of pairs of closely spaced apertures 30 through which the flexible member 56 has been passed during assembly of the toy 10. These pairs of apertures 30 are shown in the preferred embodiment positioned in a radial and circular relationship to one another, whereby each toppling member 52 is positioned on the top wall 22 in a permanent sequence for toppling. Obviously, any desired configuration, length, or line may be used to arrange the toppling members 52 for toppling, provided that the distance between each toppling member 52 is less than its height in order to achieve some contact between toppling members after being tipped and to sustain a domino effect. Moreover, although a cylindrical housing and configuration is shown in FIG. 1, the housing may be adapted to any of numerous shapes and sizes. For example, an alternative suggested configuration of toppling members 52 is shown in FIG. 4, in which a plurality of toys 10 are used, each having a square housing 12 to allow positioning of each toy 10 in close proximity to another. Moreover, at least one terminal toppling member 58 on each toy 10 is positioned for contact with a terminal toppling member 58 of an adjacent toy 1O, whereby a domino effect can be triggered from toy to toy.

Figure 2:
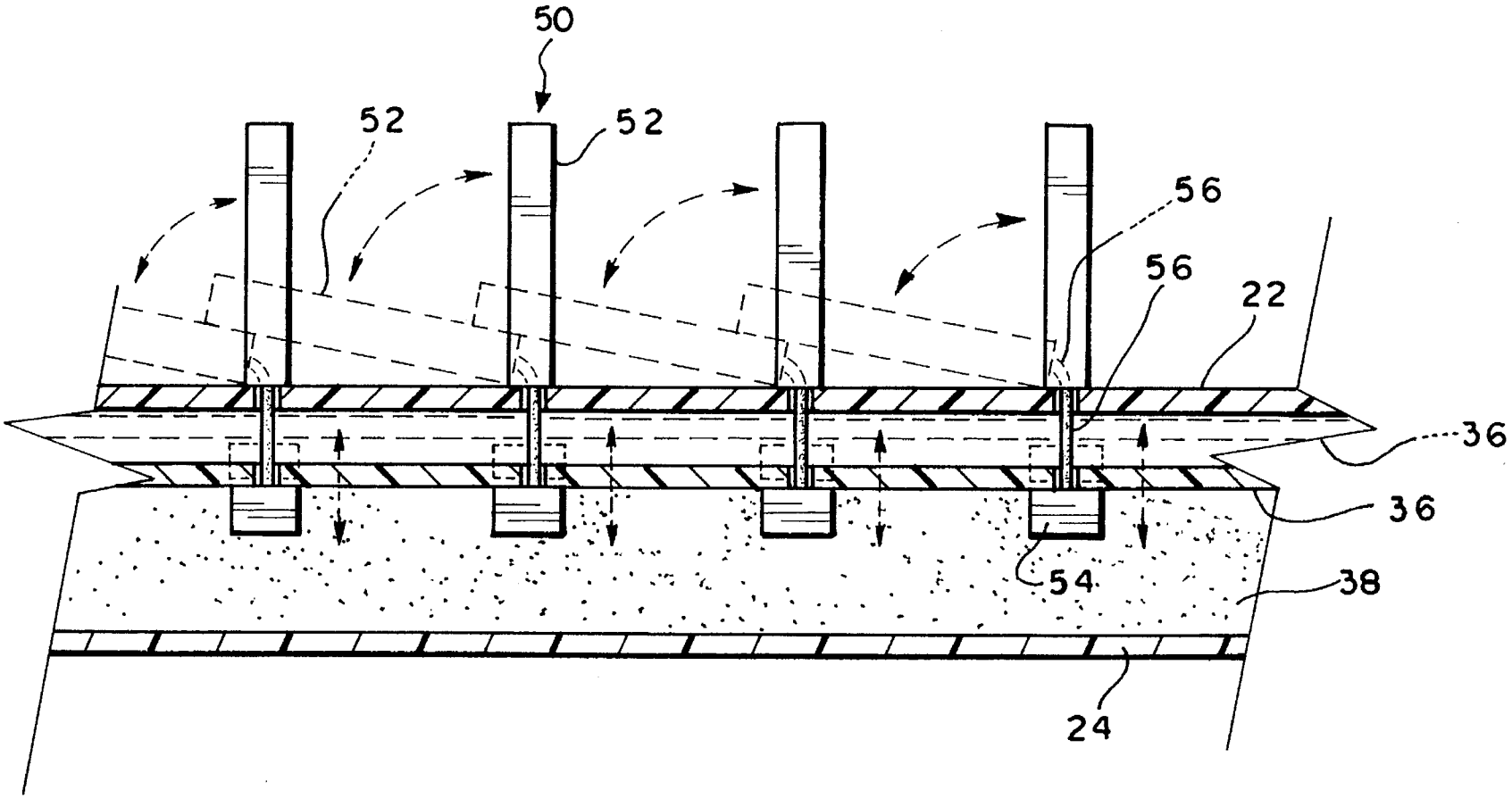
FIG. 2 is an elevational view in cross section representing the action of reset mechanism.

Referring now to both FIG. 1 and FIG. 2, the reset mechanism, generally indicated at 60, when actuated interacts with parts of the housing 20 and toppling units 50 to cause the toppling members, 52 to spring to an upright position. The top wall 22 of the housing 20 defines a concentric circular opening 32 which allows passage of a disc-shaped push-button 34 being permanently affixed to a plate or an outer circular flange 36. The plate or flange 36 defines pairs of holes 40 which are brought into registry with the pairs of apertures 30 in the top wall 22. The flange 36 is supported and biased by a resilient member 38, such as an foam annulus, resting on bottom wall 24. The foam annulus may be attached to the flange 36, obviating the need for a bottom wall 24. The resilient member 38 supports the flange 36 in close proximity to the underside of the top wall 22 in order to maintain a relationship between the ballast member 54 and the cavity 28 which allows the ballast member 54 to hang freely in the cavity 28 during the ready state of the toy 10.

Figure 3A:
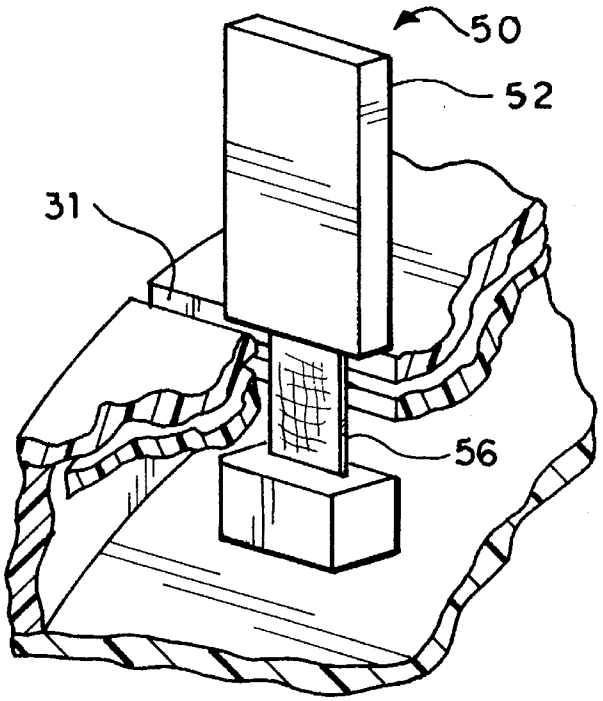
FIG. 3A is a partial, perspective view in section of a detail of a second embodiment of the toppling toy.

As can be readily observed from FIG. 1, the flexible member 56 passes through both apertures 30 and holes 40 from the toppling member 52 to the ballast member 54, freely suspending the ballast member 54 in the cavity 28 of the housing 20. However, an alternative embodiment selected from numerous other possible embodiments is suggested in FIG. 3A. The flexible member 56 is a single, flexible ribbon inserted into a slot 31 defined in each the top wall 22 and the flange 36. Of course, the toppling member 52 may be of any shape or configuration capable of resting on a level surface and triggering a domino effect.

The operation and action of the reset mechanism 60 can be best explained relative to an top wall 22 and bottom wall 24 which remain stationary. Referring now to FIG. 2, surfaces 22, 24 remain stationary throughout either an upright state or a fallen state of the toppling units 50. In the upright state, each of the toppling members 52 are vertical, resting on a narrow side, as shown in solid lines, and as previously discussed, in communication with the ballast member 54 freely suspended. In the fallen state, each of the toppling members 52 are reclining generally horizontally, shown in broken lines. Each of the flexible members 56 are in an exposed position, extending through aperture 30 and bent, having pulled the ballast member 56 upward to a position in the fallen state, each position also indicated by the broken lines. The flange 36 shown in broken lines is in a resting state, which state is present when the resilient member 38 is in an expanded, non-compressed state and supporting the flange as previously observed in FIG. 1. It should be noted that the resting state of the flange 36 may exist during either the fallen state or the upright state of the toppling units 50. However, in the fallen state, the ballast member 54 has been pulled into close proximity to the resting flange 36.

To reset each of the toppling members 52, the push-button 34 (not shown) is manually depressed, causing the flange 36 to move vertically downward and compress the resilient member 38. As the flange 36 moves downward, it reaches a point where it comes into contact with the ballast member 54. The ballast member 54 is thus forced downward and the extended flexible member 56 is thus made taut, retracting the toppling member 52 towards the aperture 30. As the flange 36 continues its downward motion drawing the flexible member 56 into and through the apertures 30, each toppling member 52 reaches a critical point at which the toppling member 52 is forced onto its lower edge, tipping the toppling member 52 back into an upright position. Because forces on the toppling member 52 are being exerted at two points by means of the flexible member 56 the toppling member 52 will not only right itself but also rotate to a position generally parallel to the adjacent toppling member. Furthermore, because the flange 36 acts simultaneously on all ballast members 54, all toppling members units 50 can be returned to an upright state simultaneously.

Once the toppling units 50 have been returned to their upright state, the push-button 34 may be released, allowing the resilient member 38 to decompress, in turn forcing the flange 36 upward to its resting state.

It is to be understood that the present invention is not limited to the embodiments described above, but encompasses any and all embodiments within the scope of the following claims.

I claim:

1. A toppling toy for amusement comprising:

a plurality of toppling units, each toppling unit further comprising a toppling member, a ballast member, and a flexible member flexibly connecting said toppling member to said ballast member, a housing, having walls defining a top wall for support of said plurality of toppling units and further defining a cavity beneath said top wall, said top wall further defining a plurality of apertures, each of said plurality of apertures for close passage of said flexible member and said each aperture dimensioned to prevent passage of said toppling member, and a plurality of said toppling member being arranged upon said top wall and spaced apart such a distance as to permit a falling toppling member within a row of toppling members to engage an adjacent upright toppling member and cause it to tip over, and each of said ballast members being housed within said cavity; and, resetting means, including a plate for selective contact with each said ballast member provided intermediate said top wall and each said ballast member, said plate defining a plurality of holes, each of said plurality of holes for close passage of said flexible member, each of said plurality of holes dimensioned to prevent passage of said ballast member, and each of said plurality of holes positioned in registry with each of said plurality of apertures, each said flexible member passing through a respective one of said plurality of holes and a respective one of each said plurality of apertures, whereby movement of said plate to its extreme position away from said top wall causes each said flexible member to become taut thereby forcing each said toppling member into an upright position;

and a resilient member biasing said plate toward said top wall.

2. The toppling toy according to claim 1, wherein said housing has an opening, said toppling toy further includes a protruding member protruding from said opening, said protruding member allowing transmittal of a force to said plate to move said plate away from said top wall.

3. The toppling toy according to claim 2, wherein said opening is located in said top wall.

4. The toppling toy according to claim 2, wherein said protruding member is a cylindrical projection projecting from said plate.

5. The toppling toy according to claim 1, further comprising a bottom wall positioned parallel to said top wall, wherein said top wall, said bottom wall and said plate are each sheet material, wherein said plate is positioned parallel and between said top wall and said bottom wall, and wherein said resilient member is a foam annulus sandwiched between said plate and said bottom wall, whereby movement of said plate away from said top wall compress said annulus.

6. The toppling toy according to claim 1, wherein said housing is dimensioned and configured to placement of said housing adjacent a housing of another toppling toy, whereby toppling of at least one said toppling member triggers toppling of a toppling member of said another toppling toy.

* * * * *